United States Patent [19]

Schoonover et al.

[11] 4,086,887

[45] May 2, 1978

[54] ROCKER ARM SHAFT SUPPORT

[76] Inventors: Alan G. Schoonover, 17110 Shadow Ct.; Gary E. Ericksen, 7771 Polinda St., both of Milwaukie, Oreg. 97222; Kenneth E. Heard, 15138 SE. Caruthers, Portland, Oreg. 97233

[21] Appl. No.: 766,331

[22] Filed: Feb. 9, 1977

[51] Int. Cl.[2] ..... F01L 1/18

[52] U.S. Cl. ..... 123/90.39; 123/90.4

[58] Field of Search ..... 123/90.39, 90.4

[56] References Cited

U.S. PATENT DOCUMENTS

| | | | |
|---|---|---|---|
| 2,713,855 | 7/1955 | Witzky | 123/90.4 |
| 3,150,648 | 9/1964 | Gropp | 123/90.39 |
| 3,870,024 | 3/1975 | Ridgeway | 123/90.41 |

*Primary Examiner*—Charles J. Myhre
*Assistant Examiner*—Jeffrey L. Yates
*Attorney, Agent, or Firm*—Chernoff & Vilhauer

[57] ABSTRACT

A support platform for mounting a rocker arm shaft in an internal combustion engine comprises an elongated base element which fits on the top surface of the cylinder head of the engine, support pads which are mounted to the base element intermediate its ends at spaced intervals, and end blocks which are attached to each longitudinal end of the base element. The rocker arm shaft is mounted in transverse bores which extend through the support pads and end blocks, and is attached to the support pads by bolts which pass through vertical bores in the support pads, the rocker arm shaft, and the base element into registry with threaded holes in the cylinder head. The end blocks engage the rocker arm shaft at each of its extremities, outwardly of the outward most rocker arm, for preventing deflection of the end portions of the rocker arm shaft upon loading of the rocker arms.

3 Claims, 3 Drawing Figures

ROCKER ARM SHAFT SUPPORT

BACKGROUND OF THE INVENTION

This invention relates to a support for preventing deflection of internal combustion engine valve components. In particular it pertains to such a support which prevents deflection of a rocker arm shaft.

In operation of high performance internal combustion engines, maintenance of valve train clearance is of critical importance. However, in operation as a valve is opened the compression of the associated valve spring causes loading on the rocker arm which in turn results in deflection of the rocker arm mounting hardware. Thus, the clearance of that particular valve is increased. Also repeated cyclic deflection of the mounting hardware causes it to fail prematurely.

In engines where each rocker arm is carried by individual upstanding studs, supports are known for eliminating deflection. One such support, for example, is shown in U.S. Pat. No. 3,870,024.

However, no such support has been developed for internal combustion engines having rocker arms which are carried rotatably on a transverse rocker arm shaft. The outermost rocker arms in particular are subject to displacement in this class of engine, as the extremities of the rocker arm shaft are unsupported outwardly of the outwardmost rocker arm.

SUMMARY OF THE INVENTION

The present invention basically comprises a rocker arm support platform configured to engage the extremities of a rocker arm shaft outwardly of the outwardmost rocker arms.

It is by virtue of the foregoing basic concept that the principal objective of the present invention is achieved; namely, to overcome the aforementioned disadvantages and limitations of prior art rocker arm shaft support platforms.

Another object of the present invention is to provide such a support platform which also carries the intermediate rocker arms with little deflection.

It is another object of the present invention to provide such a support platform which is of simplified construction for economical manufacture and is of rugged, unitary design permitting severe and extended treatment in use.

The foregoing and other objects and advantages of the present invention will appear from the following detailed description, taken in connection with the accompanying drawings of a preferred embodiment.

DETAILED DESCRIPTION OF A PREFERRED EMBODIMENT

The support platform of the present invention is used in conjunction with an internal combustion engine rocker arm assembly 10 of the type having a plurality of individually adjustable rocker arms 12 which are carried rotatably on a transverse rocker arm shaft 14.

Figure 1:
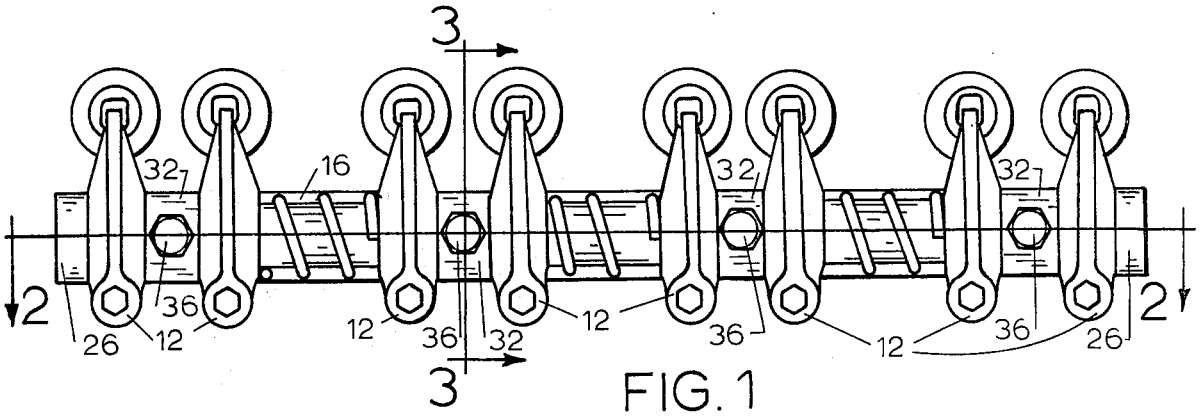
FIG. 1 is a plan view of the rocker arm shaft support of the present invention.
Figure 2:
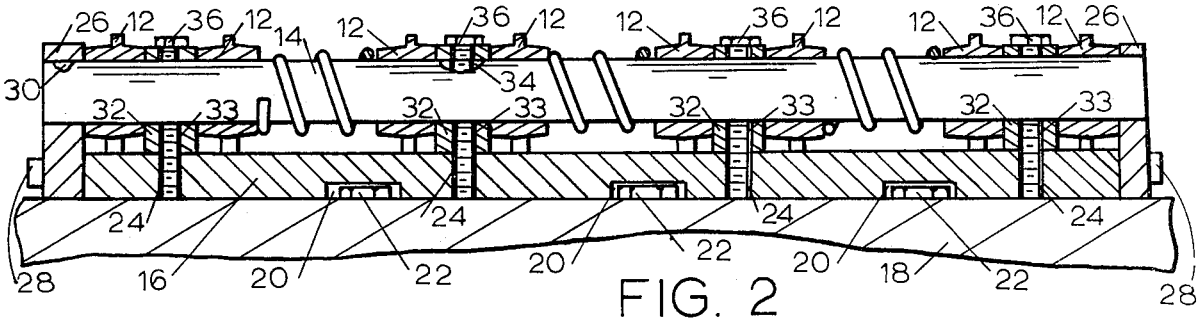
FIG. 2 is a sectional view in side elevation, partially broken away, taken on line 2—2 of FIG. 1.
Figure 3:
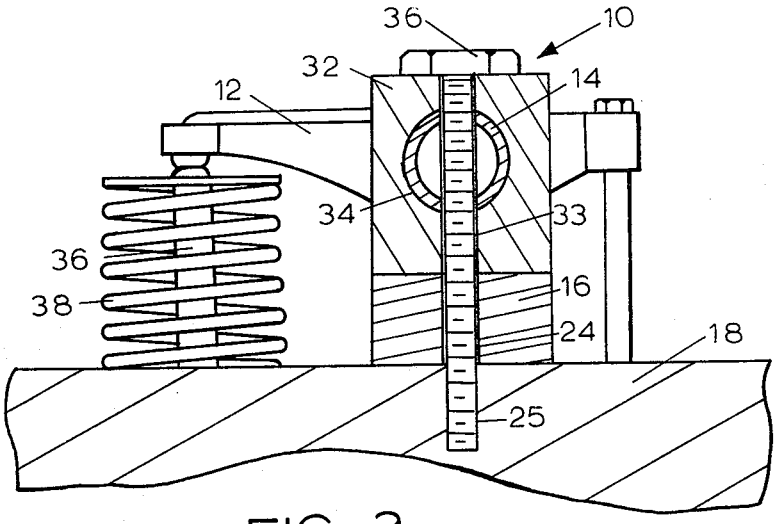
FIG. 3 is a sectional view, at an enlarged scale, taken on the line 3—3 of FIG. 1.

Referring to FIGS. 1 and 2 of the drawings, the support platform comprises an elongated base element 16 which is located on top of a cylinder head 18. The base element preferably is fabricated from steel or other rigid metal and includes recesses 20 which are located at spaced intervals in its lower surface for receiving head bolts 22. The base element must be sufficiently rigid to resist deflection in use. For a standard automotive V-8 engine it is approximately ½ inch wide, ¾ inch thick and nearly as long as the cylinder head.

Bores 24 pass through the base element at spaced intervals. The openings are arranged to align with threaded holes 25 which normally are provided in a cylinder head for mounting rocker arm assemblies to the engine. In the embodiment illustrated four such openings are provided.

Mounted to each end of the base element is an upstanding end block 26. The end blocks are attached to the longitudinal extremities of the base element by means of bolts 28. Transverse bores 30 passing medially through the end blocks are arranged for receiving the extremities of the rocker arm shaft 14 tightly.

Located on base element 16 above bores 24 are support pads 32. The support pads have vertical bores 33 passing through them which are aligned with bores 24 in the base element. Also passing through the support pads are transverse bores 34 which are arranged for receiving the rocker arm shaft 14.

Bolts 36 pass through bores 24 and 33 and holes (not shown) in the rocker arm shaft into registry with threaded holes 25 in the cylinder head. Thus when bolts 36 are tightened the support pads are secured rigidly to the base element, the base element is attached to the cylinder head, and the rocker arm shaft is secured rigidly in the support pads.

As will be noted from the drawings holes 25 in the cylinder head of a V-8 automotive engine are arranged so that support pads 32 are located intermediate every other pair of rocker arms 12. This is the same location as normally is used for rocker arm stands of the prior art.

However, the outward extremities of rocker arm shaft 14 extend outwardly of the support pads. Since the outermost rocker arms are located on the extremities of the shaft, normally they are subject to upward displacement when the extremities of the rocker arm shaft are deflected by the loading of a valve spring 38 when it is compressed during opening of a valve 40.

By supporting the extremities of the rocker arm shaft, end blocks 26 prevent this deflection of the rocker arm shaft. Therefore, the outermost rocker arms are not deflected due to valve spring loading and the clearances between the rocker arm and valve 36 and push rod 40 remain constant during operation of the engine.

Also, the rigidity of the support pads and the close mounting tolerances made possible by their being mounted to the planar upper surface of the base element, makes a rigid mount for the intermediate rocker arms. Thus all of the rocker arms will maintain nearly constant valve clearances during operation.

Having thus described our invention in a preferred embodiment, we claim:

1. A support platform for mounting internal combustion engine rocker arms of the type carried rotatably on a transverse shaft mounted outwardly of the cylinder head of the engine, the platform comprising;

(a) a base element configured for being positioned on top of the cylinder head, (b) support pads mounted to the base element, the support pads having transverse bores extending therethrough, which are arranged for receiving the rocker arm shaft, and (c) end blocks attached to each end of the base element, the end blocks having transverse bores passing therethrough for engaging the rocker arm shaft, and the end blocks being located on the base element such that they engage the rocker arm shaft outwardly of the outermost rocker arm.

2. A support platform for mounting internal combustion engine rocker arms of the type carried rotatably on a transverse rocker arm shaft mounted outwardly of the cylinder head of the engine, the platform comprising:

(a) an elongated base element configured for being positioned on top of the cylinder head, the base having a plurality of openings passing therethrough at intervals spaced to coincide with the spacing of openings which are provided in the rocker shaft for mounting the rocker arm shaft to the engine, (b) support pads mounted to the base elements in alignment with each of the openings therein, the support pads having transverse bores passing therethrough which are arranged for receiving the rocker arm shaft, and the support pads having vertical bores passing therethrough which are coaxial with the openings in the base, (c) end blocks attached to each end of the base element, the end blocks having transverse bores extending therethrough which are configured for engaging the extremities of the rocker arm shaft outwardly of each outermost rocker arm, preventing deflection of the rocker arm shaft upon loading of the outermost rocker arms, and (d) threaded fasteners configured for passing through each of the aligned vertical openings in the support pads, the openings in the rocker arm shaft, and the openings in the base into registry with threaded openings which are provided in the cylinder head for the purpose of mounting the rocker arms, for attaching the support pads and the base element to the cylinder head and for fixing the rocker arm shaft irrotatably in the openings in the support pads.

3. The support platform of claim 2 wherein there are eight rocker arms and there are four support pads, one of the support pads being located between each alternate pair of rocker arms.

* * * * *

UNITED STATES PATENT AND TRADEMARK OFFICE

CERTIFICATE OF CORRECTION

PATENT NO. : 4,086,887

DATED : May 2, 1978

INVENTOR(S) : Alan G. Schoonover et al.

It is certified that error appears in the above-identified patent and that said Letters Patent are hereby corrected as shown below:

[22] Filed: Feb. 9, 1977 --Should read Filed: Feb. 7,1977

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*